United States Patent [19]

Kadija

[11] 4,120,772

[45] * Oct. 17, 1978

[54] CELL FOR ELECTROLYZING AQUEOUS SOLUTIONS USING A POROUS ANODE SEPARATOR

[75] Inventor: Igor V. Kadija, Cleveland, Tenn.

[73] Assignee: Olin Corporation, New Haven, Conn.

[ * ] Notice: The portion of the term of this patent subsequent to Jun. 28, 1994, has been disclaimed.

[21] Appl. No.: 791,087

[22] Filed: Apr. 26, 1977

Related U.S. Application Data

[63] Continuation-in-part of Ser. No. 627,995, Nov. 3, 1975, Pat. No. 4,032,427.

[51] Int. Cl.[2] ..... C25B 11/06; C25B 13/04

[52] U.S. Cl. ..... 204/252; 204/283; 204/284; 204/290 F; 204/295; 204/296

[58] Field of Search ..... 204/296, 290 F, 295, 204/296, 283, 284, 252

[56] References Cited

U.S. PATENT DOCUMENTS

| | | | |
|---|---|---|---|
| 3,222,265 | 12/1965 | Beer | 204/1 R |
| 3,578,572 | 5/1971 | Lee | 204/95 |
| 3,702,267 | 11/1972 | Grot | 429/34 |
| 3,853,739 | 12/1974 | Kolb et al. | 204/290 F |
| 3,960,697 | 6/1976 | Kircher et al. | 204/252 |
| 4,032,427 | 6/1977 | Kadija | 204/283 |

FOREIGN PATENT DOCUMENTS

| | | | |
|---|---|---|---|
| 26,770 | 3/1975 | Japan | 204/296 |

*Primary Examiner*—F.C. Edmundson

*Attorney, Agent, or Firm*—James B. Haglind; Donald F. Clements

[57] ABSTRACT

Electrolysis of alkali metal chloride solutions to produce chlorine and alkali metal hydroxides is accomplished in a cell comprising an anode compartment, a cathode compartment and an anode separator which divides the anode compartment from the cathode compartment. The anode separator is comprised of a porous plate of a valve metal having an electrochemically active coating on the face, and an electrochemically non-active coating on the back and a portion of the interior. The electrochemically non-active barrier layer may include resinous materials, for example, polyarylene compounds or polyolefin compounds.

The anode separator provides improved gas separation properties, eliminates the need for a separate diaphragm or membrane and enables the cell to operate with reduced power requirements.

22 Claims, 3 Drawing Figures

CELL FOR ELECTROLYZING AQUEOUS SOLUTIONS USING A POROUS ANODE SEPARATOR

This application is a continuation-in-part of Ser. No. 627,995, filed Nov. 3, 1975, now U.S. Pat. No. 4,032,427, issued June 28, 1977.

This invention relates to electrodes for use in electrolytic cells. More particularly, this invention relates to a cell for electrolyzing aqueous solutions to produce gaseous products employing porous metal anodes.

It is known to employ porous metal diaphragms in electrolytic cells. U.S. Pat. No. 3,222,265, issued to H. B. Beer describes a porous metal diaphragm consisting of a porous plate of titanium having a thin layer of a noble metal on one side and a barrier layer of titanium dioxide on the other side. The pores in the diaphragm were substantially perpendicular to the faces of the plate. The diaphragm had a thickness of a fraction of a millimeter and could be used as an anode by applying current along the side of the plate coated with the noble metal.

The diaphragm of U.S. Pat. No. 3,222,265 having rectilinear pores was produced, for example, by etching the titanium plate or mechanically perforating the plate. The resulting diaphragm is a fragile structure having limited gas separation properties. In addition, there is little control over the amount of penetration of the noble metal coating into the porous plate. The short rectilinear pores have no means for preventing gas flow back through the porous structure.

In the method of U.S. Pat. No. 3,222,265, the porous metal diaphragm is placed in the electrolyte so that it separates the anolyte from the catholyte.

Therefore, there is a need for a cell and a process employing a porous anode separator which provides improved gas separation. In addition, there is need for a cell and process employing a porous anode separator which will prevent gas flow in an undesired direction and which results in reduced energy costs.

It is an object of the present invention to provide a cell and process for electrolyzing alkali metal chloride solutions having improved gas separation properties.

Another object of the present invention is a cell and process for electrolyzing alkali metal chloride solutions which eliminates the need for employing a separate diaphragm or membrane.

An additional object of the present invention is a cell and process for the electrolysis of alkali metal chloride solutions which produces purer chlorine and reduces the formation of alkali metal chlorates and alkali metal hypochlorites in the anolyte.

A further object of the present invention is a cell and process for electrolyzing alkali metal chloride solutions having reduced power requirements.

These and other objects of the present invention are accomplished in a novel cell for electrolyzing alkali metal chloride solutions comprised of an anode compartment, a cathode compartment, an anode separator dividing the anode compartment from the cathode compartment, a cathode in the cathode compartment, where the anode separator comprises a porous plate of a valve metal, the porous plate having a face, a back and an interior structure, the face having an electrochemically active coating selected from the group consisting of a platinum group metal, a platinum group metal oxide and mixtures thereof, the back and a portion of the interior having a barrier layer comprising a mixture of a valve metal oxide and a ceramic oxide selected from the group consisting of silicon oxide, aluminum oxide, magnesium oxide, calcium oxide, and mixtures thereof, wherein the portion is at least 10 percent of the interior structure.

The novel cell of the present invention is illustrated in FIGS. 1–3. Corresponding parts have the same numbers in all FIGS.

Figure 2:
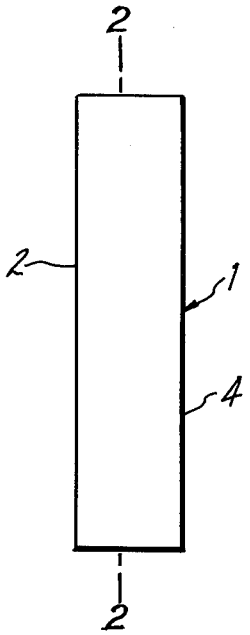
FIG. 2 depicts a cross section of the porous anode separator taken along line 2—2 of FIG. 1.
Figure 1:
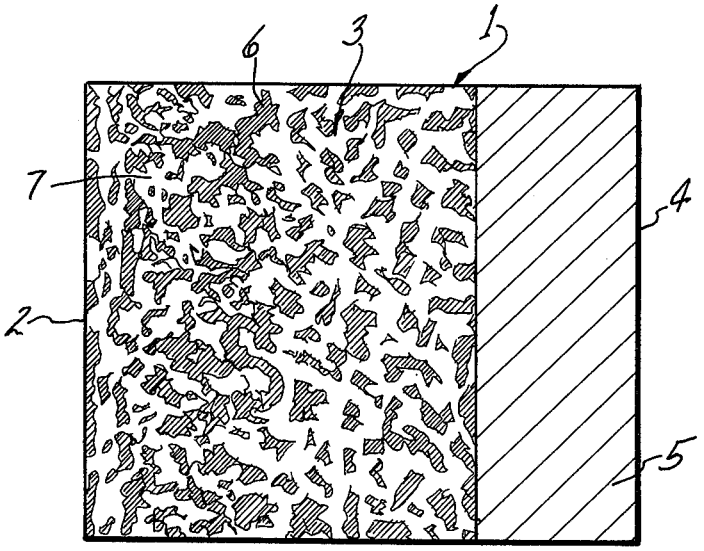
FIG. 1 represents a side view of the porous anode separator employed in the novel cell of the present invention.

In FIGS. 1 and 2, porous anode separator 1 has a face 4, a back 2, and an interior structure 3. Face 4 is coated with electroactive coating 5. Back 2 and a portion of interior structure 3 have a barrier layer which is a mixture of ceramic oxide 6 and a valve metal oxide 7.

Figure 3:
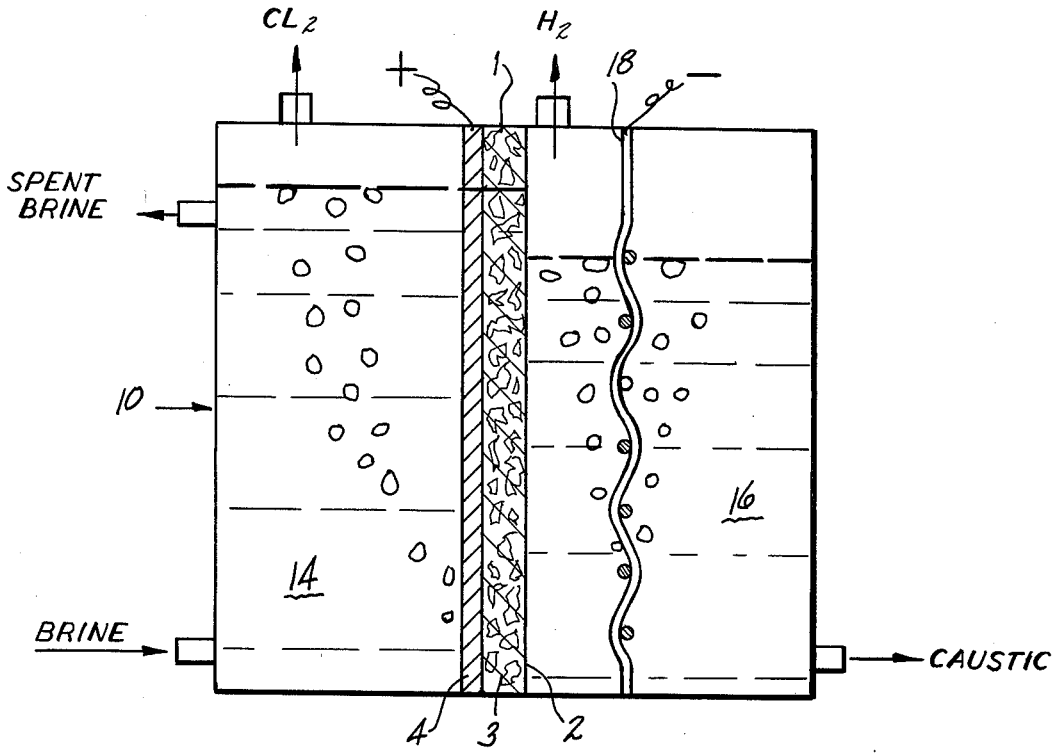
FIG. 3 illustrates a schematic view of the novel cell of the present invention.

FIG. 3 illustrates a schematic view of cell 10 in which porous anode separator 1 separates cell 10 into an anode compartment 14 and a cathode compartment 16. Cathode 18 is positioned in cathode compartment 16. Porous anode separator 1 having face 4 and back 2 is positioned so that back 2 is nearest, but spaced apart from cathode 18.

A porous plate of a valve metal is used in the anode separator employed in the cell of the present invention. The plate has a thickness of from about 1/24th to about $\frac{3}{8}$ of an inch, preferably from about $\frac{1}{8}$ to about $\frac{3}{8}$ of an inch, and more preferably from about about $\frac{1}{4}$ to about $\frac{3}{8}$ of an inch. While plates having a thickness greater than $\frac{3}{8}$ of an inch may be used, they have less desirable separation properties.

A suitable porosity for the porous plate is that of from about 30 to about 75 percent. The porosity is defined as the ratio of the void to the total volume of the porous plate. A preferred porosity is from about 40 to about 70 percent. Any convenient pore size may be used, for example, from about 5 microns to about 500 microns, preferably from about 10 to about 100 microns, and more preferably from about 25 to about 50 microns. The porosity can be random as no particular directional orientation is required, but it is preferred that the porosity be uniform throughout the porous plate.

Porous plates of valve metals are available commercially or can be produced by a process such as sintering a metal in powder form.

Where improved mechanical strength is desired for the porous plate, for example, for anodes having a large surface area, the interior of the plate may include a foraminous structure of the valve metal such as an expanded mesh or net or a perforated plate. The foraminous structure is enveloped by the porous plate. A mesh reinforced valve metal plate is commercially available, for example, from Gould, Inc.

For the purposes of this specification, a valve metal is a metal which, in an electrolytic cell, can function generally as a cathode, but not generally as an anode as an oxide of the metal forms under anodic conditions. This oxide is highly resistant to the passage therethrough of electrons.

Suitable valve metals include titanium, tantalum, or niobium, with titanium being preferred.

The porous plate is coated on the back and a portion of the interior with a barrier layer which serves as the electrochemically non-active layer. The barrier layer comprises a mixture of a valve metal oxide with a ceramic oxide. A valve metal oxide is an oxide of titanium, tantalum or niobium where the valve metal is defined as above. A preferred valve metal oxide is titanium oxide. The ceramic oxide is selected from the group consisting of silicon oxide, aluminum oxide, magnesium oxide, and calcium oxide. The barrier layer may be formed by any suitable method. For example, a ceramic oxide-forming compound may be applied to the back and interior of the porous plate as a dispersion or solution. The coating is applied to the back in a manner which will permit the compound to permeate the porous inner structure of the anode, but will not coat the face, that is the side which will have an electrochemically active coating. The porous plate may then be heated to a temperature of from about 350° C. to about 800° C. in an oxygen-containing atmosphere to form the barrier layer comprising a mixture of the valve metal oxide and the oxide of Si, Mg, Ca or Al, or mixtures thereof. Any suitable compounds may be used in preparing the ceramic oxide portion of the barrier layer. Silica-containing compositions such as fumed or colloidal silica, for example, Cab-O-Sil ® sold by the Cabot Corporation or silicone rubber may be used to provide silicon oxide. $MgCO_3$ or $Mg(OH)_2$, $CaCO_3$ or $Ca(OH)_2$ or $Al(OH)_3$ may similarly be used to prepare the oxides of Mg, Ca or Al, respectively. Where mixtures of oxides are desired, the compounds of Mg, Ca or Al may be mixed with, for example, a silicone rubber composition and the mixture applied to the back and interior of the porous anode separator. If desired, a solvent or carrier such as hexane, may be added to the mixture to provide increased permeation through the interior portion of the anode separator. Other suitable carriers include, for example, a solution of cellulose acetate in acetone, mixtures of ammonium glutamate in water or alkali metal chloride brines.

In another embodiment, a valve metal oxide may be added to the ceramic oxide in forming the barrier layer.

As a component of the mixture, the ceramic oxide is present in amounts of from about 10 percent to about 70 percent by volume of the total mixture. Preferably, the ceramic oxide constitutes from about 20 percent to about 40 percent by volume of the total mixture. While any of the ceramic oxides may be suitably used in the barrier layer of the novel anode separator of the present invention, silicon oxide and aluminum oxide and mixtures of silicon oxide and aluminum oxide are preferred, with silicon oxide being most preferred.

In an added embodiment, resinous materials may be incorporated to increase the density of the barrier layer. Suitable resins are those which are resistant to the gases and solutions which are found in a cell for the electrolysis of an alkali metal chloride solution. These include, for example, polyarylene compounds and polyolefin compounds.

Polyarylene compounds include polyphenylene, polynaphthylene and polyanthracene derivatives. For example, a useful group of polyarylene resins are polyarylene sulfides such as polyphenylene sulfide or polynaphthylene sulfide. Polyarylene sulfides are well known compounds whose preparation and properties are described in the *Encyclopedia of Polymer Science and Technology* (Interscience Publishers) Vol. 10, pages 653–659. In addition to the parent compounds, derivatives having chloro-, fluoro- or alkyl substituents may be used such as poly(perfluorophenylene) sulfide and poly(methylphenylene) sulfide.

Polyolefin compounds suitable for use in the barrier layer include polymers of olefins having from 2 to about 6 carbon atoms in the primary chain, for example, polyethylene, polypropylene, polybutylene, polypentylene and polyhexylene, as well as their chloro- and fluoro-derivatives such as polyvinyl chloride, polyvinylidene chloride, polytetrafluoroethylene, fluorinated ethylene-propylene (FEP), polychlorotrifluoroethylene, polyvinyl fluoride, and polyvinylidene fluoride. Also suitable are copolymers of ethylene with halogenated alkanes such as monochlorofluoroethane or haloolefins such as chlorotrifluoroethylene.

Resinous materials are used in particulate forms such as granules or powders where the particle size is preferably smaller than 100 mesh and more preferably from about 150 to about 250 mesh.

Any suitable amount of resinous material may be used in the layer, for example, from about 5% to about 50% by volume of the total mixture of components comprising the barrier layer. Preferably, the resinous material constitutes from about 20% to about 40% by volume of the total mixture.

The barrier layer thickness on the back of the porous anode separator is not critical and any suitable thickness may be employed which is electrochemically non-reactive with respect to the alkali metal chloride solution.

To serve as an effective separator, at least about 10% of the interior structure should be coated by the barrier layer mixture. For example, a satisfactory anode separator is obtained by coating a proportion of from about 10% to about 90% of the interior structure with the barrier layer. A preferred proportion is from about 30% to about 70% of the interior structure of the porous plate. For effective gas separation properties, it is desirable that where the porous anode separator has a thickness of at least ⅛ of an inch, the electrochemically non-reactive barrier layer have a thickness of at least 1/25th of an inch.

The face of the porous titanium plate is coated with a platinum group metal or platinum group metal oxide or mixtures thereof using any of several well known procedures, as described, for example, in U.S. Pat. No. 3,853,739, issued to Kolb et al, or U.S. Pat. No. 3,578,572, issued to Lee. The term "platinum group metal" as used in the specification means an element of the group consisting of ruthenium, rhodium, palladium, osmium, iridium, and platinum.

Where the electrochemically active coating includes a platinum group metal oxide, the oxidation procedure used to form the barrier layer can be employed simultaneously to form the platinum group metal oxide. Suitable platinum group metal oxides include those selected from the group consisting of platinum oxide, palladium oxide, iridium oxide, ruthenium oxide, rhodium oxide and osmium oxide with ruthenium oxide being preferred.

Any suitable thickness may be used for the electrochemically active coating providing the coating is present in an amount sufficient to function effectively as an anode in the electrolysis of alkali metal chloride solutions. Where the porous anode separator serves as both the anode and the diaphragm, it is desirable that the electrochemically active layer comprise at least 10% and preferably from about 30 to about 70% of the total thickness of the separator.

While any suitable portion of the face of the porous anode plate may be coated with the electrochemically active coating, it is preferred that the electrochemically active coating essentially cover the anode face.

Further, the electrochemically active coating may be made partly hydrophobic by applying a coating of a polymeric material such as polytetrafluoroethylene, for example, by spraying or painting over a portion of the face of the porous anode.

In the novel cell of the present invention, the anode separator is positioned so that it serves as the divider between the anode compartment and the cathode compartment. The back or non-conductive portion of the anode separator is closest to and spaced apart from the cathode. Suitable distances between the anode separator and the cathode are, for example, from about 1/50th to about ½, preferably from about 1/32nd to about ¼ of an inch.

The cell of the present invention suitably electrolyzes, for example, aqueous solutions of alkali metal chlorides to produce chlorine and an alkali metal hydroxide solution. Alkali metal chloride solutions having a pH of from about 2 to about 11 are fed to the anode compartment.

During electrolysis, for example, of an aqueous solution of a sodium chloride, electrolytic decomposition takes place along the face of the anode separator. Chlorine gas is formed and released along the electrochemically active face with little penetration of chlorine into the interior structure because of the barrier layer. Hydrated Na ions formed during the electrolysis, along with sodium chloride solution and water molecules pass through the porous anode structure into the cathode compartment.

Any suitable cathode may be used in the cathode compartment, for example, foraminous structures of metals such as steel, nickel, copper or alloys thereof.

The cell of the present invention can be used for the electrolysis of alkali metal chloride solutions including sodium chloride, potassium chloride, lithium chloride, rubidium chloride and cesium chloride, with sodium chloride and potassium chloride being preferred. Aqueous solutions of these alkali metal chlorides are fed to the anode compartment.

The cell of the present invention is further illustrated by the following examples.

EXAMPLE 1

A commercially available porous titanium plate 1/16th of an inch thick and having a porosity of 60 percent and an average pore size of 25 microns was coated on one side with a thin protective coat of silicone rubber (General Electric Co. RTV-102). The silicone rubber penetrated the interior of the porous plate, but was prevented from coating the face of the plate. The rubber coated side was cured at room temperature over a 2 hour period. The face or uncoated side of the porous titanium plate was then painted with a 10 percent solution of $RuCl_4$ in 0.1N HCl. The plate was then baked in an oven at 400° C. for 5 minutes. Following cooling, the face was recoated with the $RuCl_4$ solution and the porous plate then heated in an oven having an air atmosphere for about 6 hours at 400° C. During this heating, the silicone rubber coated titanium was oxidized and a mixture of silicon dioxide and titanium dioxide formed on the back and throughout the porous structure of the plate. An electrochemically active coating of ruthenium dioxide formed on the front of the plate. Photomicrographs obtained using a scanning electron microscope established that the silicon dioxide was evenly distributed throughout the barrier layer as a mixture with titanium dioxide containing about 30 percent by volume of $SiO_2$. The barrier layer mixture covered about 50 percent of the interior structure of the porous plate.

The overpotential characteristics of the anode of the Example were determined by connecting the anode in an electrolytic cell containing a cathode, a reference electrode and sodium chloride as the electrolyte. The anode-cathode gap was about 1 mm. Electrolysis of the sodium chloride was conducted at the following current densities and the overpotential determined.

| Current Density | Overpotential of Anode Separator of Example (In millivolts) |
|---|---|
| 0.1 | 35 |
| 1.0 | 55 |
| 3.0 | 75 |
| 5.0 | 95 |
| 10.0 | 125 |

The anode separator was thus shown to function as an anode in the electrolysis of sodium chloride.

EXAMPLE 2

A porous titanium plate ¼ of an inch thick was produced which enclosed a piece of expanded titanium mesh 0.048 of an inch thick and having 50 percent open space. The porous plate had a porosity of 60 percent and an average pore size of 25 microns. A mixture of 8 mls. of silicone rubber, 8 mls. of $Al_2O_3$ and 12 mls. of hexane was prepared and applied to one side of the porous plate with a paint roller. Sufficient pressure was used to assure penetration of the mixture into the interior portion of the porous plate. The rubber coated side was cured at room temperature over a 2 hour period. The face or uncoated side of the porous titanium plate was then painted with a 10 percent solution of $RuCl_4$ in 0.1N HCl. The plate was then baked in an oven at 400° C. for 5 minutes. Following cooling, the face was recoated with the $RuCl_4$ solution and the porous plate then heated in an oven having an air atmosphere for about 6 hours at 400° C. During this heating, the silicone rubber coated titanium was oxidized and a mixture of silicon dioxide, aluminum oxide, and titanium dioxide formed on the back and the interior portion of the plate. An electrochemically active coating of ruthenium dioxide was formed on the plate. The anode separator was installed in a cell of the type of FIG. 3 to separate the anode compartment from the cathode compartment. The electroactive face of the anode separator served as the anode and the non-conductive back and interior portion served as the diaphragm. The back of the anode separator was spaced apart from a steel mesh cathode a distance of about ⅛ of an inch. Sodium chloride brine (300 grams per liter) was fed to the anode compartment. Electric current was supplied to the electroactive face of the anode separator to provide a current density of 1.5 $KA/m^2$ of anode surface. A plexiglass cell body permitted visual observations during electrolysis which verified that $Cl_2$ gas was evolved only in the area adjacent to the face of the anode separator. An aqueous solution of sodium hydroxide was produced in the cathode compartment. At a concentration of 108 grams per liter of NaOH, cathode current efficiency was 95 percent at a cell voltage of 3.1 V., with the power consumption being 2213 KWH per ton of $Cl_2$ produced. The cell was operated for one week. After completion of this period, the anode separator was split apart and the barrier mixture found to cover about 60 percent of the interior structure of the porous plate. The electrochemically active coating was found to have penetrated about 40 percent of the interior structure.

EXAMPLE 3

A porous titanium plate of the type of Example 2 and having a thickness of ⅛ of an inch, a porosity of 60 percent and an average pore size of 25 microns was employed as the anode separator. A mixture of 8 mls. of silicone rubber, 8 mls. of $Al_2O_3$, 12 mls. of hexane and 0.2 mls. of a copolymer having a 1:1 ratio of ethylene to monochlorofluoroethane was prepared. The barrier layer and electroactive coating of $RuO_2$ were produced by the procedure of Example 2. The anode separator was installed in the cell of Example 2 as the anode-diaphragm. A steel mesh cathode was spaced apart from the back of the anode separator a distance of ⅛ of an inch. Sodium chloride brine (300 grams per liter) was fed to the anode compartment. Electric current sufficient to provide a current density of 4 $KA/m^2$ of anode surface was supplied to the face of the anode separator. Electrolysis was conducted for a period of 48 hours. During this time, chlorine gas was produced along the active face of the anode separator. An aqueous solution of sodium hydroxide was produced in the cathode compartment in concentrations of from about 57 to 103 grams per liter. Caustic current efficiencies up to 96 percent were obtained at a voltage coefficient of 0.50 $V/KA/m^2$. After completion of the electrolysis period, the anode separator was split apart and the barrier layer mixture was found to cover about 60 percent of the interior structure of the porous plate.

EXAMPLE 4

A porous plate ⅛ of an inch of the type of Example 2 was impregnated and coated by the procedure of Example 2 in which the only change was the substitution in the barrier layer mixture of 0.5 mls. of polyphenylene sulfide resin (Phillips Petroleum Company) Ryton-PPS Type V-1) for the 0.2 mls. of the copolymer of ethylene and monochlorofluoroethane. The anode separator was employed as the anode-diaphragm in the cell of Example 2, spaced apart ⅛ of an inch from the steel mesh cathode. Electrolysis of NaCl solutions (300 grams per liter) at a current density of 4 $KA/m^2$ produced sodium hydroxide solutions in the cathode compartment in the range of 40 to 91 grams per liter of NaOH over a period of 72 hours. Current efficiencies up to 90 percent were obtained at a cell voltage coefficient of 0.32 $V/KA/m^2$. Following the electrolysis the anode-separator was broken apart and the barrier layer mixture found to cover about 45 percent of the interior structure of the porous plate.

What is claimed is:

1. A cell for electrolyzing alkali metal chloride solutions comprised of an anode compartment, a cathode compartment, an anode separator dividing the anode compartment from the cathode compartment, a cathode in the cathode compartment, where the anode separator comprises a porous plate of a valve metal selected from the group consisting of titanium, tantalum, and niobium, said porous plate having a face, a back and an interior structure, said face having an electrochemically active coating selected from the group consisting of a platinum group metal, a platinum group metal oxide and mixtures thereof, said back and a portion of said interior having an electrochemically non-active barrier layer comprising a mixture of an oxide of titanium, tantalum, or niobium and a ceramic oxide selected from the group consisting of silicon oxide, aluminum oxide, magnesium oxide, calcium oxide, and mixtures thereof, wherein said portion is at least 10 percent of said interior structure.

2. The cell of claim 1 wherein said ceramic oxide is silicon oxide.

3. The cell of claim 1 wherein said valve metal is titanium and said porous plate has a thickness of from about 1/24th to about ⅜ of an inch.

4. The cell of claim 3 wherein said porous plate has a porosity of from about 30 percent to about 75 percent.

5. The cell of claim 4 wherein said porous plate has a pore size of from about 5 microns to about 500 microns.

6. The cell of claim 4 wherein said valve metal oxide is selected from the group consisting of titanium oxide and tantalum oxide.

7. The cell of claim 6 wherein said ceramic oxide is silicon oxide.

8. The cell of claim 6 wherein said ceramic oxide is a mixture of silicon oxide and aluminum oxide.

9. The cell of claim 7 wherein said electrochemically active coating is a platinum group metal oxide selected from the group consisting of platinum oxide, palladium oxide, iridium oxide, ruthenium oxide, rhodium oxide and osmium oxide.

10. The cell of claim 9 wherein said electrochemically active coating is ruthenium oxide.

11. The cell of claim 10 wherein said valve metal oxide is titanium oxide.

12. The cell of claim 1 wherein said portion of said interior structure having said barrier layer is from about 10 to about 90 percent.

13. The cell of claim 10 wherein said porous plate has a foraminous structure of a valve metal enveloped by said porous plate.

14. The cell of claim 13 wherein said foraminous structure is an expanded mesh.

15. The cell of claim 14 wherein said valve metal is titanium.

16. In an anode separator including in combination a porous plate of a valve metal, said porous plate having a face, a back and an interior structure, said face having en electrochemically active coating selected from the group consisting of a platinum group metal, a platinum group metal oxide and mixtures thereof, said back and a portion of said interior having a barrier layer mixture of a valve metal oxide and a ceramic oxide selected from the group consisting of silicon oxide, aluminum oxide, magnesium oxide, calcium oxide, and mixtures thereof, wherein said portion is at least 10 percent of said interior structure, the improvement which comprises including in the barrier layer a density increasing proportion of a resinous material.

17. The anode separator of claim 16 wherein said resinous material comprises from about 5 to about 50 percent by volume of the total mixture comprising the barrier layer.

18. The anode separator of claim 17 wherein said resinous material is a polyarylene sulfide compound.

19. The anode separator of claim 18 wherein said polyarylene sulfide compound is polyphenylene sulfide.

20. The anode separator of claim 17 wherein said resinous material is a polymer of a compound selected from the group consisting of olefins, chlorosubstituted olefins and fluorosubstituted olefins, said olefins having from 2 to about 6 carbon atoms in the primary chain.

21. The anode separator of claim 20 wherein said compound is selected from the group consisting of ethylene, tetrafluoroethylene, vinyl chloride, chlorotrifluoroethylene, polyvinyl fluoride and polyvinylidene fluoride.

22. The anode separator of claim 20 wherein said resinous material is a copolymer of ethylene and monochlorofluorethane.

* * * * *